US005129170A

United States Patent [19]

Fusilli

[11] Patent Number: 5,129,170

[45] Date of Patent: Jul. 14, 1992

[54] SNOWPLOW MOUNTING, REMOVAL, AND STORAGE SYSTEM

[76] Inventor: Anthony T. Fusilli, 180 West Hill Estates, Rochester, N.Y. 14626

[21] Appl. No.: 743,728

[22] Filed: Aug. 12, 1991

[51] Int. Cl.[5] ..... E01H 5/06

[52] U.S. Cl. ..... 37/231; 37/271; 16/19; 16/29; 16/30; 280/767

[58] Field of Search ..... 37/231, 232, 270, 271, 37/266; 16/19, 30, 29; 280/767, 47.151; 172/460

[56] References Cited

U.S. PATENT DOCUMENTS

| | | | |
|---|---|---|---|
| 299,494 | 5/1884 | Price | 16/30 |
| 1,171,569 | 2/1916 | Wanda | 16/30 |
| 1,460,440 | 7/1923 | Polk | 37/271 X |
| 1,517,016 | 11/1924 | Relien | 37/271 X |
| 2,152,092 | 3/1939 | Rougier | 37/231 |
| 2,168,440 | 8/1939 | Dole | 280/767 X |
| 3,463,505 | 8/1969 | German et al. | 16/30 X |
| 3,889,981 | 6/1975 | Westford | 280/767 X |
| 4,803,790 | 2/1989 | Ciula | 37/266 |
| 4,821,435 | 4/1989 | Pester | 37/231 |

*Primary Examiner*—Randolph A. Reese
*Assistant Examiner*—Arlen L. Olsen
*Attorney, Agent, or Firm*—Robert J. Bird

[57] ABSTRACT

A system for mounting, removal, and storage of a snowplow includes a caster removably mounted on the rear crossbar of the plow A-frame. The caster shaft is threaded for adjustability of the vertical position of the crossbar. Front wheels are removably mounted on the right and left ends of the plow blade.

9 Claims, 5 Drawing Sheets

SNOWPLOW MOUNTING, REMOVAL, AND STORAGE SYSTEM

FIELD OF THE INVENTION

This invention is an improvement in snowplows, and more particularly a system to facilitate mounting, removal, and storage of a snowplow.

BACKGROUND INFORMATION

In parts of the country where snow is a normal part of winter, snow plowing is a significant activity. Public roads are usually plowed by public highway authorities with large equipment. Plowing of private roads and driveways is commonly done by light or medium duty snowplows mounted on pick-up trucks. Typically the pick-up truck snowplow is usually kept mounted on the truck for the duration of the snow season, which might be as long as six months in some areas.

The plow is usually left on the truck because mounting and removing it is such a job as to deter most owners from doing it for every snowfall. They simply mount the plow in the fall and remove it in the spring. This schedule is disadvantageous for several reasons. The front end of the truck is unduly burdened with a load for which it is not designed. Tires and bearings are overloaded and they wear faster. Fuel efficiency is drastically reduced because of windage. The plow on the front of the truck creates a traffic hazard and a parking problem.

The object of this invention to facilitate mounting, removal, and storage of a snowplow, so that it can and will be mounted and removed as needed.

The only relevant prior art that I am aware of is a dolly used to transport a snowplow to a truck for mounting, and from the truck for storage.

SUMMARY OF THE INVENTION

The present invention is a system for mounting, removal, and storage of a snowplow. A caster is removably mounted on the rear crossbar of the plow A-frame by a mounting clevis. The clevis which is threaded on the caster shaft for adjustability of its vertical position on the caster shaft. Front wheels are removably mounted on the right and left ends of the plow blade. The front wheels each include a wheel housing with a base plate and a top plate together forming a mounting slot which fits over a flange on the back of the plow blade. In another form, the front wheels each include a vertical rod adapted to fit on a corresponding rod depending from the back of the plow blade.

DRAWING

DESCRIPTION

Figure 1:
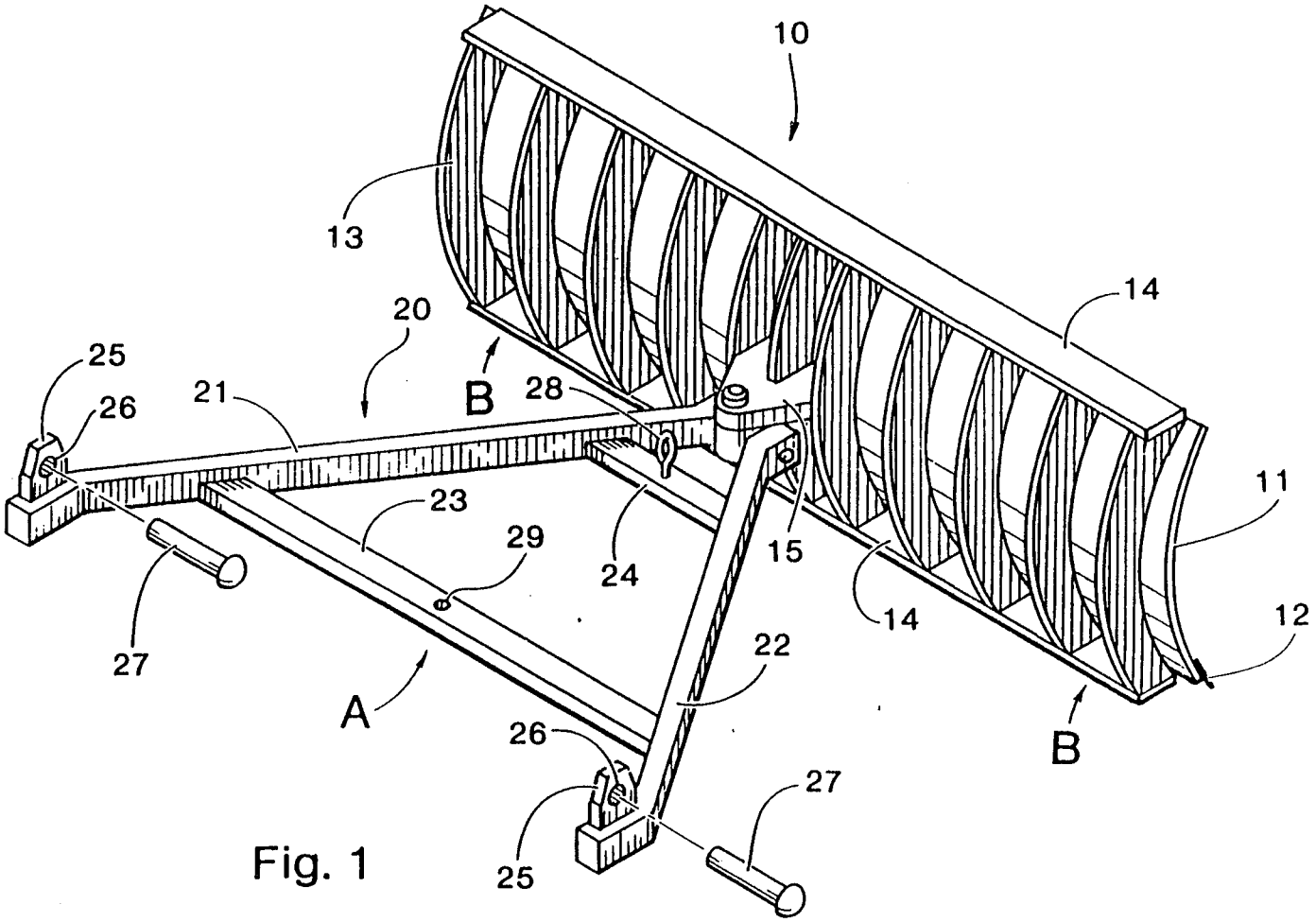
FIG. 1 is a perspective view showing the environment of the invention.

Referring to FIG. 1, a snowplow 10 includes a blade 11 with a front cutting edge 12, vertical ribbing 13 extending between upper and lower horizontal flanges 14 on the back of the blade, and a pivot connection 15 to an A-frame assembly 20. The A-frame assembly 20 includes a left arm 21 and a right arm 22, a rear crossbar 23, and a front crossbar 24. The forward ends of the arms 21 and 22 are joined to the snowplow at the pivot connection 15. The arms 21 and 22 each include a mounting lug 25 with a bolt hole 26 to accomodate a mounting bolt or pin 27. The front crossbar 24 includes an eye or other suitable means 28 for connection to a chain and to a hydraulic lift which is part of the "mount" on the front of the truck on which this snowplow is to be mounted. The rear crossbar 23 may or may not include a vertical bolt hole 29 at its center. Locations for casters and wheels according to this invention are indicated at A and B.

Figure 2:
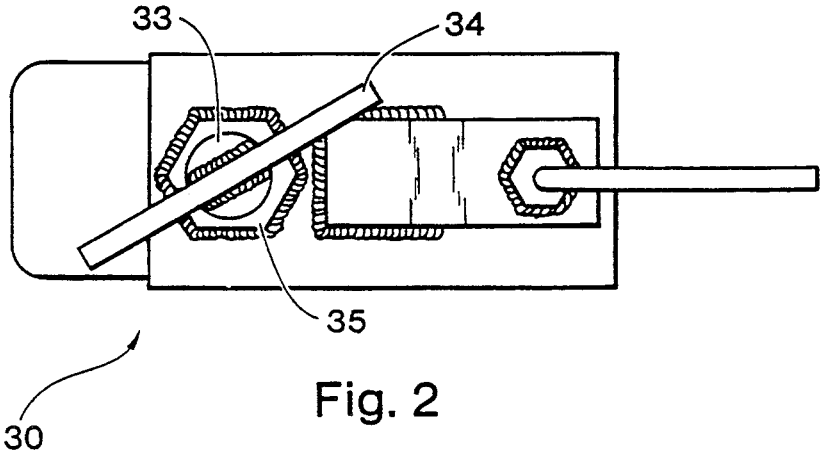
FIG. 2 is a top view of the rear caster assembly.
Figure 3:
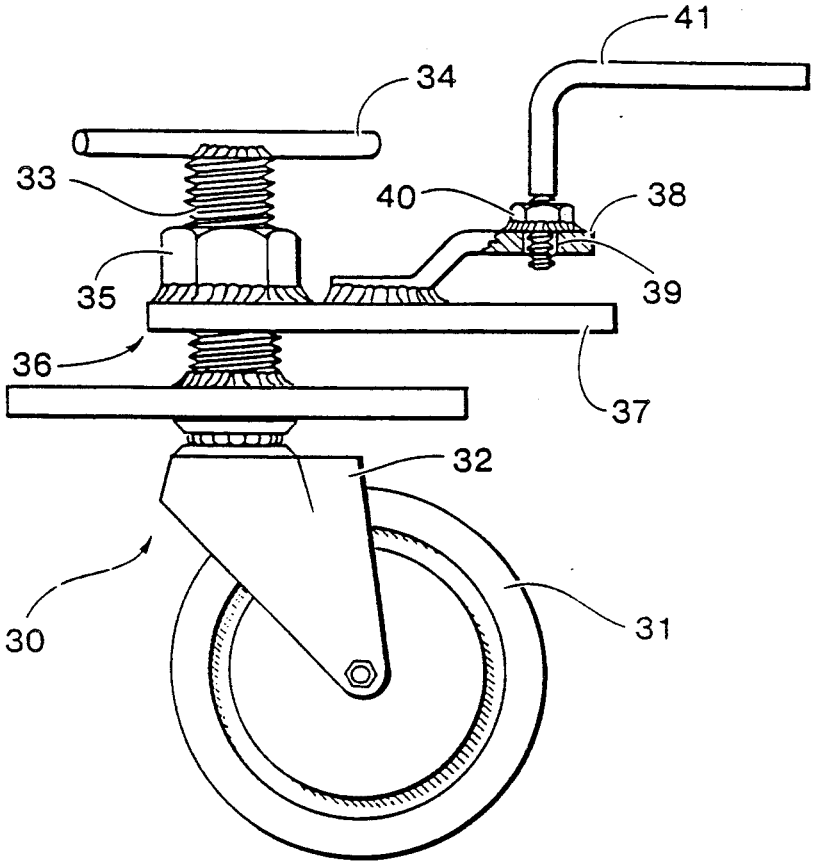
FIG. 3 is an elevation view of the rear caster assembly of FIG. 2.

FIGS. 2 and 3 are top and side views of a caster assembly 30 which is to be removably mounted n the rear crossbar 23 of the A-frame assembly. The caster assembly 30 includes a caster wheel 31 rotatably mounted in a caster wheel housing 32 which is in turn swivel mounted on a vertical caster shaft 33 (or conversely, the caster shaft 33 is rotatable relative to the housing 32). The caster shaft 33 is threaded, and includes a radial arm or handle 34 extending from its upper end. A clevis nut 35 is welded to a mounting clevis 36 which includes a lower clevis plate 37 and an upper clevis plate 38 welded together. The clevis nut 35, with mounting clevis 36, is threaded on the caster shaft 33. The upper clevis plate 38 includes a bolt hole 39 and a nut 40 welded in alignment with it. A bolt or preferably an L-shaped screw 41 is threaded into the nut 40 and through the bolt hole 39.

The mounting clevis 36 of the caster assembly 30 straddles the rear crossbar 23 of the A-frame, over the bolt hole 29, and is fastened to the rear crossbar 23 by the screw 41 clamping against the crossbar 23 (or extending through the bolt hole 29 if there is one). The screw 41 is easily turned so that the caster assembly is easily mounted on and removed from the rear crossbar 23.

The clevis nut 35 is threaded on the caster shaft 33 for adjustment of its vertical position on the shaft 33 to thereby adjust the height of the A-frame 20 for alignment of its bolt holes 26 with corresponding bolt holes on the truck mount for ease of insertion and removal of the mounting pins 27.

Figure 4:
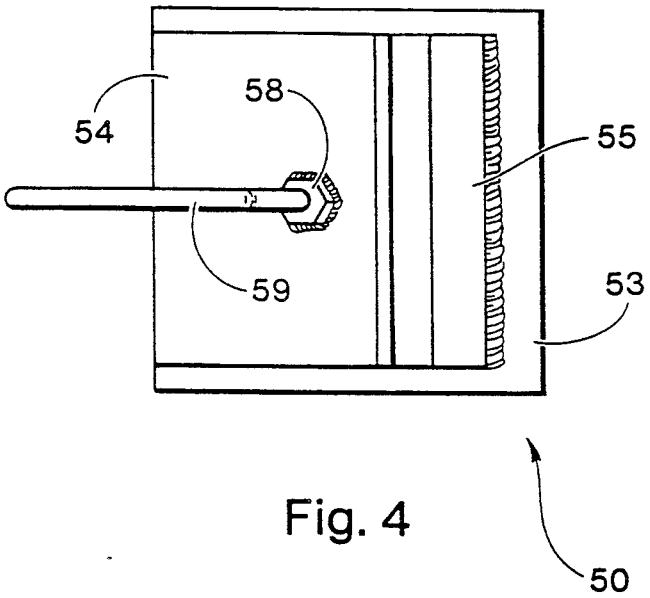
FIG. 4 is a top view of a front wheel assembly.
Figure 5:
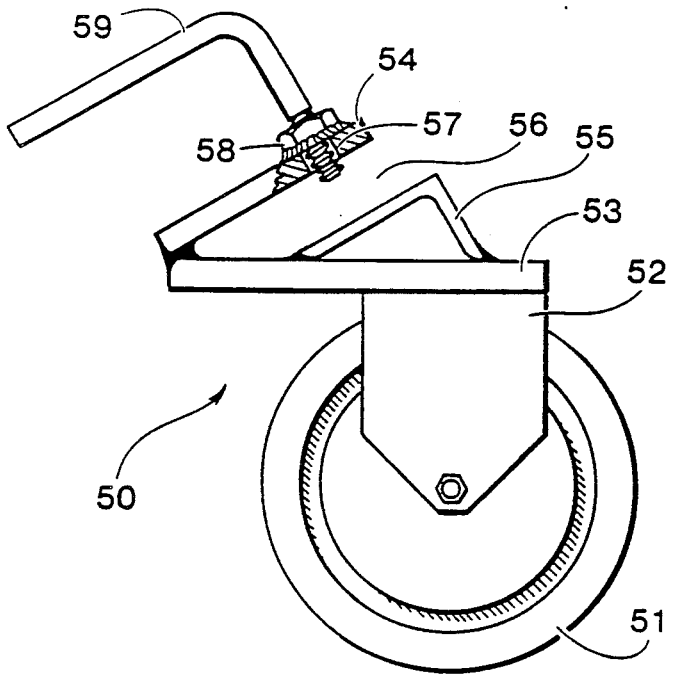
FIG. 5 is an elevation view of the front wheel assembly of FIG. 4.
Figure 6:
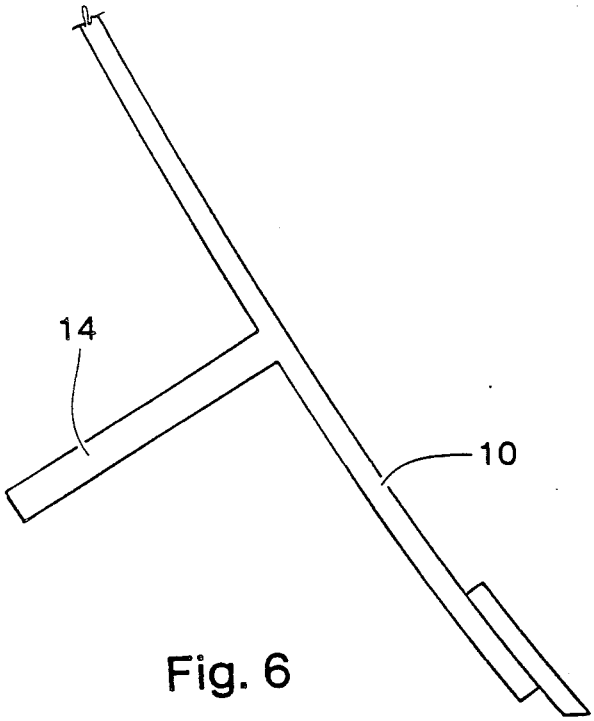
FIG. 6 is a partial side elevation view of a snowplow blade.

FIGS. 4 and 5 are top and side views of a front wheel assembly 50, and FIG. 6 a partial side view of a standard snowplow 10 with a lower horizontal flange 14 on the back of the blade. The wheel assembly 50 is to be removably mounted on the snowplow. It includes a wheel 51 rotatably mounted in a wheel housing 52. The housing 52 includes a base plate 53, a top plate 54 extending upward at an acute angle from the base plate 53, and an angle iron 55 positioned so that angle iron 55 and top plate 54 together form a mounting slot 56. The top plate 54 includes a bolt hole 57 and a nut 58 in alignment with it. Base plate 53, top plate 54, angle iron 55 and nut 58 are welded or otherwise fastened together. An L-shaped clamp screw 59 is threaded into the nut 58 and through the bolt hole 57.

The top plate 54 and angle iron 55 of the wheel assembly 50 (FIG. 5) straddle the lower horizontal flange 14 on the snowplow (FIG. 6) and the wheel assembly is clamped to the flange 14 by the clamp screw 59 extending through the nut 58 and bolt hole 57, and bearing on the flange 14. The clamp screw is easily tightened and loosened so that the wheel assembly 50 is easily mounted on and removed from the flange 14 of the snowplow.

Figure 7:
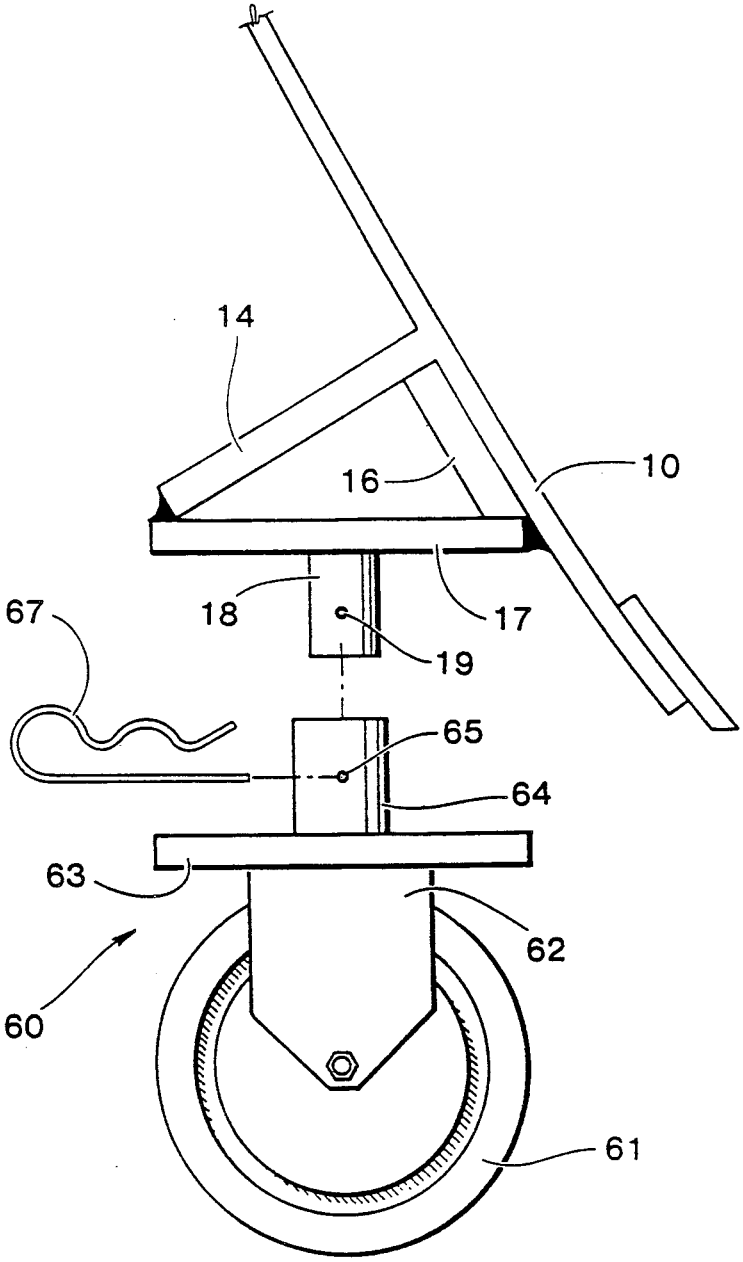
FIG. 7 is a partial side elevation view of another form of this invention.

FIG. 7 is a partial side view of a modified snowplow 10. A reinforcing plate 16 is fastened to the back of the snowplow blade 11 below the flange 14. A cross plate 17 extends between the bottom of the reinforcing plate 16 and the outer edge of the flange 14. The flange 14, reinforcing plate 16, and cross plate 17 thus form a triangular section, preferably at only the two end locations where the wheels are to be mounted, though it may be along the entire length of the blade 11. The cross plate 17 includes a short depending rod 18 with a transverse bolt hole 19. A front wheel assembly 60, to be removably mounted on the snowplow, includes a wheel 61 rotatably mounted in a wheel housing 62. The housing 62 includes a base plate 63 and a hollow vertical rod 64 on the base plate 63. The vertical rod 64 is of such size as to fit over the rod 18, and includes a bolt hole 65. With rod 64 in position on rod 18, a pin 67 is inserted through the aligned bolt holes 65 and 19 to thereby fasten the wheel assembly to the snowplow. The pin 67 is easily inserted and removed so that the wheel assembly is easily mounted on and removed from the snowplow.

The system is used as follows. With the plow raised and ready to be removed from its truck mount, the rear caster 30 is attached to the A-frame, and the front wheels 50 are attached to the snowplow blade. The plow is lowered and the hydraulic system relaxed. The mounting pins 27 are removed and the snowplow and A-frame are free to be rolled away and stored. The vertical adjustment of the rear caster (i.e. the adjustment of the clevis nut 35 on the caster shaft 33) is such that with the plow lowered and the hydraulics relaxed, the mounting pins 27 slip easily in and out of the bolt holes 26 and their corresponding bolt holes on the truck mount. For mounting, the process is reversed. The plow is simply rolled in place and connected to the mount by inserting the mounting pins 27. The plow is then raised and the caster 30 and wheels 50 removed. One person can easily do this. The casters allow the plow to be moved as desired for cleaning or for organizing storage space.

Because existing snowplows usually have a lower flange like flange 14 in FIG. 6, the front wheel arrangement of FIG. 5 is considered especially appropriate for use on existing equipment. Two of these wheels units 50, and one rear caster unit 30 are all that is needed to convert an existing snowplow into one having the mounting, removal, and storage benefits of this invention.

The arrangement of FIG. 7 was devised primarily for original equipment manufacture, where conversion of existing equipment is not involved.

The foregoing description of a preferred embodiment of this invention, including any dimensions, angles, or proportions, is intended as illustrative. The concept and scope of the invention are limited only by the following claims and equivalents thereof.

What is claimed is:

1. A snowplow mounting, removal, and storage system, including:

a snowplow including a blade with a horizontal flange on the back thereof, and an A-frame operatively connected to said blade;

said A-frame including left and right arms, each including a mounting lug for connection to a vehicle mount, and a rear crossbar extending between said arms;

a rear caster assembly removably mounted on said rear crossbar, and including a caster wheel housing rotatably mounted on a threaded caster shaft, a nut with an integral mounting clevis in threaded engagement on said caster shaft, means to releasably clamp said rear crossbar within said mounting clevis, and means to turn said caster shaft relative to said nut to adjust the vertical position of said clevis on said caster shaft; and a front wheel assembly removably mounted on each end portion of said horizontal flange on said blade, each said assembly including a wheel housing with a base plate and a top plate together forming a mounting slot, and means to releasably engage said flange within said slot.

2. A snowplow mounting, removal, and storage system, including:

a snowplow including a blade with upper and lower horizontal flanges on the back thereof, and an A-frame operatively connected to said blade;

said A-frame including left and right arms, each including a mounting lug with a bolt hole and mounting pin, for connection to a vehicle mount; and a rear crossbar extending between said arms; and a rear caster assembly removably mounted on said rear crossbar, and including a caster wheel housing rotatably mounted on a threaded caster shaft, a nut with an integral mounting clevis in threaded engagement on said caster shaft, a clamp operatively connected on said mounting clevis for releasable clamping engagement of said rear crossbar within said mounting clevis, and handle means on said caster shaft to turn said shaft relative to said nut to adjust the vertical position of said caster shaft relative to said clevis to render said mounting pins freely movable into and out of said bolt holes when said vehicle mount is lowered and relaxed, thereby to facilitate mounting and removal of said snowplow.

3. The system defined in claim 2 in which said clamp is a clamp screw.

4. A snowplow mounting, removal, and storage system, including:

a snowplow including a blade with upper and lower horizontal flanges on the back thereof, and an A-frame operatively connected to said blade;

said A-frame including left and right arms, each including a mounting lug with a bolt hole and mounting pin, for connection to a vehicle mount, and a rear crossbar extending between said arms;

a rear caster assembly removably mounted on said rear crossbar, and including a caster wheel housing rotatably mounted on a threaded caster shaft, a nut with an integral mounting clevis in threaded engagement on said caster shaft, a clamp operatively connected on said mounting clevis for releasable clamping engagement of said rear crossbar within said mounting clevis, and a handle on said caster shaft to turn said shaft relative to said nut to adjust the vertical position of said caster shaft relative to said clevis; and a front wheel assembly removably mounted on each end portion of said lower flange on said blade, each said assembly including a wheel housing with a base plate, a top plate extending upward at an acute angle therefrom, an angle iron positioned on said base plate, said angle iron and said top plate together forming a mounting slot, and a clamp operatively connected on said top plate for releasable clamping engagement of said lower flange within said slot.

5. The system defined in claim 4 in which each said clamp is a clamp screw.

6. A snowplow mounting, removal, and storage system including:

a snowplow including a blade with upper and lower horizontal flanges on the back thereof, and an A-frame operatively connected to said blade;

said A-frame including left and right arms, each including a mounting lug with a bolt hole and mounting pin, for connection to a vehicle mount, and a rear crossbar extending between said arms; and a rear caster assembly removably mounted on said rear crossbar, and including a caster wheel housing rotatably mounted on a threaded caster shaft, a nut with an integral mounting clevis in threaded engagement on said caster shaft, a clamp operatively connected on said mounting clevis for releasable clamping engagement of said rear crossbar within said mounting clevis, and a handle on said caster shaft to turn said shaft relative to said nut to adjust the vertical position of said caster shaft relative to said clevis;

a cross plate extending between said blade and said flange on each end portion thereof forming a triangular section, said cross plate including a depending rod; and a front wheel assembly removably mounted on each said cross plate, each said assembly including a wheel housing with a base plate, a hollow rod extending up from said base plate to fit over said depending rod, and means to releasably secure said hollow rod to said depending rod.

7. The system defined in claim 6 in which said clamp is a clamp screw.

8. A rear caster assembly for removable mounting on the rear crossbar of an A-frame operatively connected to a snowplow blade, said rear caster assembly including:

a threaded vertical caster shaft with a caster wheel housing rotatably mounted on the bottom end thereof;

a nut threaded on said caster shaft;

a mounting clevis fixed to said nut and extending horizontally therefrom to straddle said rear crossbar;

a clamp operatively connected to said mounting clevis for releasable clamping engagement with said rear crossbar; and a radial handle on the top end of said vertical caster shaft to turn said shaft relative to said nut to adjust the vertical position of said caster shaft relative to said clevis to thereby adjust the height of said A-frame to facilitate mounting and removal of said snowplow.

9. The system defined in claim 8 in which said clamp is a clamp screw.

* * * * *